United States Patent [19]

Anderson

[11] Patent Number: 4,819,847

[45] Date of Patent: Apr. 11, 1989

[54] HOLDER FOR TRIANGULAR CARPENTER'S SQUARE

[75] Inventor: Ron Anderson, Mesa, Ariz.

[73] Assignee: Texas Instruments Incorporated, Dallas, Tex.

[21] Appl. No.: 37,989

[22] Filed: Mar. 14, 1987

[51] Int. Cl.[4] ..... A45F 5/00

[52] U.S. Cl. ..... 224/252; 224/904; 224/197; 224/225

[58] Field of Search ..... 224/904, 197, 232, 234, 224/247, 248, 225, 269, 907, 252; 206/224, 214, 371

[56] References Cited

U.S. PATENT DOCUMENTS

| | | | |
|---|---|---|---|
| D. 257,410 | 10/1980 | Rink | 224/904 X |
| 2,387,900 | 10/1945 | Hartwell | 224/197 |
| 4,223,820 | 9/1980 | Vorsanger et al. | 224/904 |

*Primary Examiner*—Henry J. Recla
*Assistant Examiner*—Linda J. Sholl
*Attorney, Agent, or Firm*—Frederick J. Telecky, Jr.; James T. Comfort; Melvin Sharp

[57] ABSTRACT

A specialized carpenter's tool holder adapted to hold a carpenter's speed square onto a wearer's belt. The holder consists of a holding portion, a locking mechanism, a support backing for the holding portion and a spring clip for attaching the holder onto the wearer's belt. Specifically, the holding portion is configured from a single strip of metal configured to form a generally triangular-shaped member. The triangular-shaped member further consists of a pair of co-planar members forming the apex of the triangular-shaped member and a base member which is outwardly displaced from the plane of the co-planar members and joins each of the pair of co-planar members to form the base angles of the triangular-shaped member. The base member is configured into a T-shape to engage the T-shaped edge of the carpenter's speed square when the tool is inserted into the holder. A locking mechanism is provided by skewing the ends of the cross-member portion of the T-shaped base member to increase frictional binding of the holder on the speed square.

9 Claims, 1 Drawing Sheet

HOLDER FOR TRIANGULAR CARPENTER'S SQUARE

BACKGROUND OF THE INVENTION

The present invention relates generally to holders for carpenter's squares and, in particular, to a holder for a triangular carpenter's square (hereafter referred to as "speed square").

Carpenters normally use specially designed tool aprons and tool belts to conveniently carry their tools and other necessary equipment while on the job. These belts include loops for hammers, pouches for tape measures, and pockets for nails.

Until recent years, carpenters used the traditional L-shaped square having one short leg and one long leg which was carried in a loop on the carpenter's belt, or insered beneath the belt. Now carpenters are replacing the L-shaped square with the smaller, more convenient speed square. This square can neither fit in a loop nor safely be inserted beneath the belt, but requires a special holder to be attached to the belt. Although a carrying apparatus has been designed, such prior art does not include any means for locking the speed square into place while the carpenter is moving around and bending over.

Conventional speed square holders are represented by U.S. Pat. No. 4,223,820 to Guy E. Vorsanger and Michael J. Nickel on Sept. 23, 1980, and U.S. Design Pat. No. 257,410 to Fred M. Rink on Oct. 21, 1980. Neither such carriers provide for a means to lock the speed square into place to keep the square from falling out while the carpenter is moving around. Other tool holders and pouches not designed as holders for speed squares are disclosed, for example, in U.S. Pat. Nos. 4,457,462; 3,516,584; 3,343,735; and 4,129,237 as a general tool holder, wrench holster, trowel holster, and golfer's aid respectively.

SUMMARY OF THE INVENTION

It is, therefore, an object of the present invention to provide an apparatus to hold a speed square which attaches to the belt of the carpenter.

It is also an object of the present invention to provide a speed square holder which may attach at any location on the carpenter's belt and freely rotate with the worker's movements to insure that the speed square will not disengage from the holder.

It is further an object of the present invention to provide a means whereby the speed square is secured while the carpenter is moving around, but is readily removeable by the carpenter.

These and other objects, features and advantages of the present invention, hereinafter disclosed, will become more apparent from the following, more detailed, description of the present invention with reference to the accompanying drawings.

DESCRIPTION OF THE PREFERRED EMBODIMENT

Figure 1:
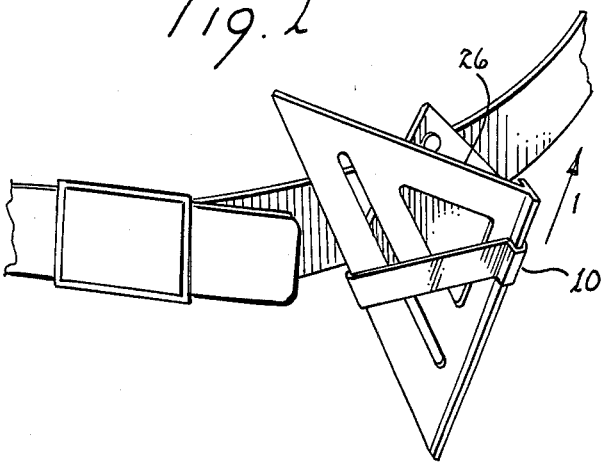
FIG. 1 is a front elevational view of the holder attached to an associated belt with a speed square inserted therein.
Figure 2:
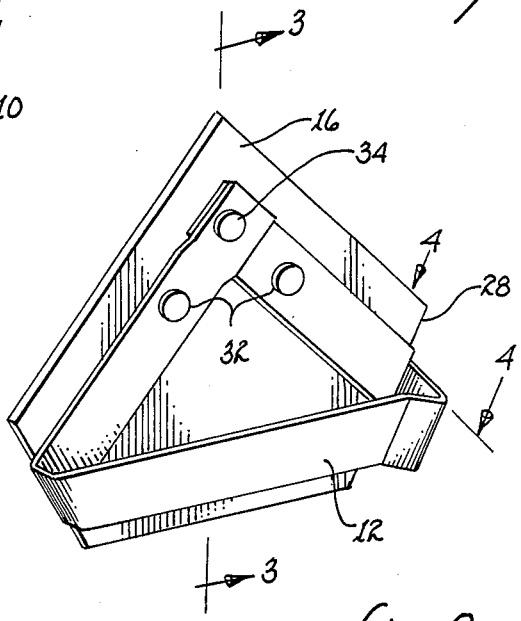
FIG. 2 is a perspective view of the holder.

Referring to the accompanying drawings, and in particular with reference to FIG. 1, there is shown a speed square holding apparatus 10 attached to a carpenter's belt with a speed square 26 inserted such that the speed square is locked into place. Arrow 1 of FIG. 1 shows the pull direction for removal of the speed square from the apparatus to release the locking mechanism. As shown in FIG. 2, the apparatus 10 consists generally of a holding mechanism 12, a locking mechanism 14, a support 16, and a clipping mechanism 18.

Figure 4:
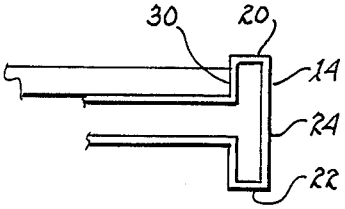
FIG. 4 is a fragmentary top elevational view along line 4—4 in FIG. 2.
Figure 3:
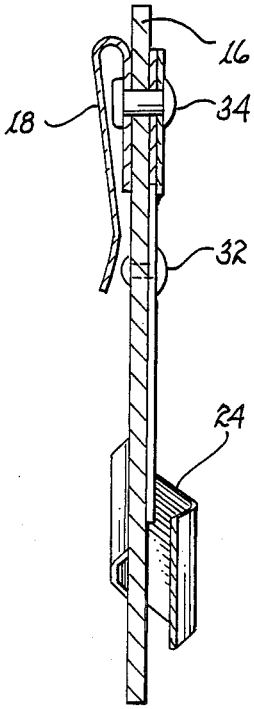
FIG. 3 is a cross-sectional side elevational view along line 3—3 in FIG. 2.
Figure 5:
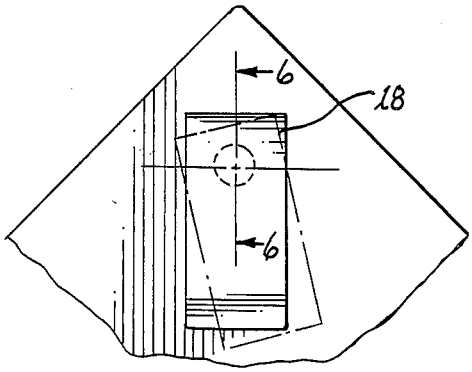
FIG. 5 is a fragmentary rear elevational view showing the ability of the attaching device to rotate.
Figure 6:
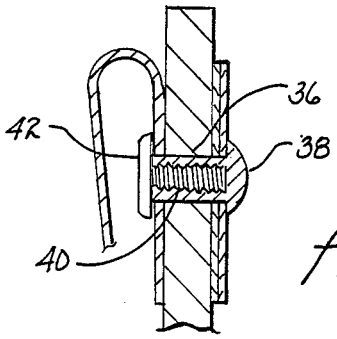
FIG. 6 is a fragmentary cross-sectional view along line 6—6 in FIG. 5.

The holding mechanism 12 and the locking mechanism 14 are preferably constructed from a single strip of suitably rigid sheet metal generally contoured to the cross-sectional T-shape of the speed square as shown in FIG. 3. The holding mechanism 12 and the locking mechanism 14 are shaped in a generally planar triangular configuration when viewed from the front. The holding mechanism 12 and the locking mechanism 14 are generally shaped in a T-configuration when viewed from a top elevational view, with sufficient width to allow the speed square 26 to appropriately slip into the mechanism, as shown in FIG. 4. The locking mechanism 14 is further constructed such that a side 20 and a side 22 of the locking mechanism's cross member 24 are sightly skewed from parallel and serve to frictionally secure the speed square into place when the speed square is inserted therebetween.

The support 16 is constructed of flexible or rigid material and is used to support the holding mechanism 12 and the locking mechanism 14. The support 16 may be shaped in any suitable shape. Preferably, support 16 has a trapezoidal configuration with a right hand side 28 of the support 16 cut approximately parallel to the angle created by the locking mechanism 14, and generally adjacent to an inner most edge 30 of the locking mechanism 14 as shown in FIG. 4. The support 16 should not intersect a directional angle created by edge 30 of the locking mechanism 14, and preferably directly abutts edge 30.

The holding mechanism 12 and the locking mechanism 14 are securely fixed to the support 16 by a plurality of securing devices 32 and a fastening device 34. The fastening device 34 attaches the clipping device 18 to the support 16 in a freely rotatable manner. The fastening device 34 preferably consists of a hollow jacket 36 having a solid head 38 constructed of rigid material, which is inserted through apertures in holding mechanism 12 and the support 16. The fastening device 34 preferably further consists of a solid insert 40 having a head 42 which is inserted through an aperture in clipping mechanism 18 and screwably attached to the hollow jacket 36.

Clipping mechanism 18 is constructed of a rigid sheet of metal contoured to securely hold the support 16 to the carpenter's belt. According to the preferred embodiment of the present invention, clipping mechanism 18 consists of a spring clip.

It can be seen, therefore, that the present invention provides an easy to use apparatus adapted to hold and secure into place a speed square onto a carpenter's belt. It is apparent that there has been provided, in accordance with the present invention and the preferred embodiments thereof, a speed square holding apparatus for a carpenter's belt which meets and achieves the objects and advantages set forth herein. The invention has been particularly described and illustrated with reference to certain embodiments thereof, but it is not intended that the invention be strictly limited to these embodiments. Those having ordinary skill in the art will recognize that variations and modifications differing from these embodiments, but falling wiithin the spirit and scope of the invention, are possible. Other materials or configurations, for example, are contemplated by the present invention. All such variations and modifications as fall within the appended claims are therefore considered within the scope of the invention.

I claim:

1. A speed square tool holder, comprising:

a generally triangular-shaped holding mechanism having first and second substantially co-planar members forming an apex of said generally triangular-shaped holding mechanism and a third member spaced apart from said two substantially co-planar members, defining a base of said generally triangular-shaped holding mechanism and a slot therebetween;

a locking mechanism having a generally T-shaped cross-section and providing a connection between one of said first and second substantially co-planar members and third member of said generally triangular-shaped holding mechanism, for engaging a T-shaped edge of a speed square tool and frictionally locking the speed square within said generally triangular-shaped holding mechanism the other of said first co-planar members being directly connected to said third member;

a support member securely fastened to said generally triangular-shaped holding mechanism; and clip means for removeably attaching said support member to a wearer, said clip means being freely rotatable with respect to said support member.

2. A speed square holder according to claim 1, wherein said holding mechanism and said locking mechanism comprise a single strip of a suitably rigid metal integrally configured to form said generally triangular-shaped holding mechanism and said locking mechanism.

3. A speed square holder according to claim 1, wherein opposing ends of a cross member-portion of said T-shaped locking mechanism are not parallel, thereby frictionally binding the speed square into place when inserted into said holding mechanism.

4. A speed square holder according to claim 1 wherein the said support member is composed of a flexible material.

5. A speed square holder according to claim 1 wherein the said support member is alternately composed of a rigid material.

6. A speed square holder according to claim 1 wherein the said clip means further comprises a rigid sheet of contoured metal.

7. A speed square holder according to claim 6 wherein said clip means contoured metal comprises a spring clip.

8. A speed square holder comprising:

a support backing;

securing means for removeably securing the speed square therein, said securing means further comprising a generally triangular-shaped planar member having a pair of substantially co-planar members forming an apex of said triangular-shaped planar member, a lower member outwardly displaced from and joined to each of said pair of substantially co-planar members, said outwardly displaced lower member and one of said substantially co-planar members being joined to form a generally T-shaped slot adapted to receivably engage the speed square;

spring clip means for attaching the tool holder to a wearer, said spring clip means being freely rotatably attached to said support backing.

9. A speed square holder according to claim 8 wherein said support backing is securely fastened to said securing means.

* * * * *

UNITED STATES PATENT AND TRADEMARK OFFICE

CERTIFICATE OF CORRECTION

PATENT NO. : 4,819,847

DATED : Apr. 11, 1989

INVENTOR(S) : Ron Anderson

It is certified that error appears in the above-identified patent and that said Letters Patent is hereby corrected as shown below:

On the title page, delete "[73] Assignee: Texas Instruments Incorporated, Dallas, Tex.".

Signed and Sealed this

Thirtieth Day of June, 1992

*Attest:*

DOUGLAS B. COMER

*Attesting Officer*

*Acting Commissioner of Patents and Trademarks*